US011509053B2

(12) United States Patent
Filatov

(10) Patent No.: US 11,509,053 B2
(45) Date of Patent: Nov. 22, 2022

(54) DUAL BROADBAND ANTENNA SYSTEM FOR VEHICLES

(71) Applicant: Advanced Automotive Antennas, S.L.U., Barcelona (ES)

(72) Inventor: Evgenii Filatov, Viladecavalls (ES)

(73) Assignee: ADVANCED AUTOMOTIVE ANTENNAS, S.L.U., Barcelona (ES)

( * ) Notice: Subject to any disclaimer, the term of this patent is extended or adjusted under 35 U.S.C. 154(b) by 245 days.

(21) Appl. No.: 16/455,973

(22) Filed: Jun. 28, 2019

(65) Prior Publication Data

US 2020/0006850 A1 Jan. 2, 2020

(30) Foreign Application Priority Data

Jun. 29, 2018 (EP) ..... 18382488

(51) Int. Cl.
*H01Q 5/385* (2015.01)
*H01Q 1/24* (2006.01)
(Continued)

(52) U.S. Cl.
CPC ..... *H01Q 5/385* (2015.01); *H01Q 1/241* (2013.01); *H01Q 1/32* (2013.01); *H01Q 1/48* (2013.01); *H01Q 9/42* (2013.01)

(58) Field of Classification Search
CPC . H04B 7/04; H01Q 9/42; H01Q 1/521; H01Q 1/48; H01Q 5/378; H01Q 5/385;
(Continued)

(56) References Cited

U.S. PATENT DOCUMENTS

2006/0170600 A1* 8/2006 Korva ..... H01Q 9/0421 343/702
2006/0227052 A1* 10/2006 Tavassoli Hozouri ... H01Q 9/36 343/700 MS
(Continued)

FOREIGN PATENT DOCUMENTS

KR 1020160061770 A 6/2016
KR 1020180025066 A 3/2018
WO 2015041768 A1 3/2015

OTHER PUBLICATIONS

Extended European Search Report for European Application No. 19173844.2; Date of Completion: Nov. 8, 2019 dated Nov. 14, 2019; 11 Pages.

*Primary Examiner* — Dimary S Lopez Cruz
*Assistant Examiner* — Jae K Kim
(74) *Attorney, Agent, or Firm* — Cantor Colburn LLP

(57) ABSTRACT

A dual broadband and multiband antenna system of reduced dimension is preferably an external antenna for vehicles. The antenna system comprises first and second radiating elements and a flat ground plane in common for the two radiating elements. The two radiating elements are placed above the ground plane, with each radiating element being folded to form vertical and horizontal surfaces. The two vertical surfaces are orthogonal to the ground plane and parallel to each other. The horizontal surfaces are coplanar between vertical surfaces and parallel to the ground plane. Two parasitic elements are connected with the ground plane, and are parallel or coplanar with the horizontal surfaces, and extend partially around respectively the first and second radiating elements. The antenna system is preferably adapted to operate on the LTE communication network and provides 5G communication services.

20 Claims, 5 Drawing Sheets

(51) Int. Cl.
*H01Q 1/32* (2006.01)
*H01Q 1/48* (2006.01)
*H01Q 9/42* (2006.01)

(58) Field of Classification Search
CPC ..... H01Q 21/28; H01Q 1/241; H01Q 9/40; H01Q 1/32; H01Q 1/3208
See application file for complete search history.

(56) References Cited

U.S. PATENT DOCUMENTS

2012/0154237 A1* 6/2012 Ying ..... H01Q 5/378 343/833
2013/0038494 A1* 2/2013 Kuonanoja ..... H01Q 9/42 343/745
2013/0044036 A1* 2/2013 Kuonanoja ..... H01Q 5/371 343/893
2013/0241779 A1* 9/2013 Korva ..... H01Q 1/243 343/700 MS
2014/0071008 A1* 3/2014 Desclos ..... H01Q 19/021 343/745
2015/0263423 A1* 9/2015 Park ..... H01Q 9/42 342/374
2016/0028150 A1* 1/2016 Chou ..... H01Q 1/243 343/702
2016/0218431 A1* 7/2016 Gaddi ..... H01Q 1/241
2017/0222321 A1* 8/2017 Caratelli ..... H01Q 9/0485
2019/0027824 A1* 1/2019 Pajona ..... H01Q 7/00
2019/0267713 A1* 8/2019 Jeong ..... H01Q 21/065
2020/0106183 A1* 4/2020 Fabrega Sanchez ..... H01Q 21/065
2020/0203848 A1* 6/2020 Tarng ..... H01Q 9/30

* cited by examiner 3.7 GHz

5 GHz 4.1 GHz

DUAL BROADBAND ANTENNA SYSTEM FOR VEHICLES

CROSS-REFERENCES TO RELATED APPLICATIONS

This patent application claims priority to European Provisional Patent Application No. 18382488.7, filed Jun. 29, 2018, which is incorporated herein by reference in its entirety.

INTRODUCTION

The present disclosure relates to broadband and multiband antennas, and more particularly to broadband and multiband antennas used as remote or external antennas for vehicles.

Due to the large size of some electronic devices, it is difficult to accommodate a large antenna system inside a reduced space. For this reason, many communication devices of motor vehicles require remote (external) antennas to increase the performance of an internal antenna. In that scenario, it is critical that the dimension of the external antenna be as small as possible so that it can be fitted inside a reduced space within a vehicle.

External antennas produce less electronic noise than internal antennas. Internal antennas should obtain worst sensitivity of the whole system as being nearer of the electronic noise sources (clocks, microprocessors, etc.). Therefore, in case of the external antennas this situation is improved as they can be moved out from these noise sources.

For example, LTE antennas require at the same time both a main antenna and a diversity antenna. However, these two LTE antennas (main and diversity) cannot be accommodated in the narrow interior of a shark fin antenna, especially in the low frequency band (700 MHz-1 GHz), wherein signal interference is high, and the level of the un-correlation obtained between the antennas would be poor. When more than one antenna is needed on a mobile system as LTE, antennas must be as uncorrelated as possible between them.

On the other hand, in more current cellular technologies, the number of cellular antennas included in the car has increased, as well as the requested performance. For LTE systems, typically two (2) antennas are used. With regard to the more current evolutions of LTE antennas and for the upcoming 5G antennas, the number of antennas will increase, requiring at least four (4) cellular antennas in the vehicles.

However, vehicle styling is more important every day, and therefore antennas may be hidden and preferably do not impact vehicle external designs, therefore the available space for antennas is reduced.

In this scenario, it is also preferable to integrated two antennas in a single box with reduced space in order to reduce the number of antenna modules (i.e., with two antennas in each module) that the vehicle manufacturer needs to install in a vehicle during production.

Furthermore, it is a challenge to integrate a multiband, high efficient, low VSWR LTE antenna in this reduced dimension.

Therefore, it is desirable to develop an improved antenna system for a vehicle having a reduced size, with high efficiency, and broadband behaviour. It is also desirable to have an antenna system that operates on all LTE frequency bands without losing broadband and high efficient characteristics in any band.

SUMMARY

An object of the present disclosure is to provide a broadband, multiband, and high efficiency antenna system of reduced dimensions, and capable of being fitted within a confined space, for example inside a component of a vehicle.

The antenna system of the present disclosure is preferably adapted to operate on the LTE communication network, and to provide 5G communication services.

The antenna system is defined in the attached independent claim, and it refers to an antenna topology that fulfills the above-described challenges of the prior art, by providing an antenna topology comprising two radiating elements sharing a common ground plane that features a broad bandwidth and high efficiency, and that it can be fitted inside a reduced space within a vehicle. The effect of having two radiating elements placed over a common ground plane, is that the bandwidth of the overall antenna system is increased.

The antenna system comprises first, and second radiating elements placed above an upper surface of the ground plane, and are folded such as each radiating element has a vertical surface and a horizontal surface.

The vertical surfaces of the two radiating elements are substantially orthogonal to the ground plane and parallel to each other, and the horizontal surfaces are substantially coplanar between them and parallel to the ground plane.

The area of the vertical surfaces widen progressively from the respective feeding points towards the respective horizontal surfaces. Preferably, the vertical surfaces have an asymmetric triangular shape, such as two feeding ports are respectively connected between a vertex of the vertical surfaces and the ground plane.

The vertical surfaces shaped as triangles are monopole elements that improve the antenna system overall bandwidth, especially at the upper range of the antenna system band of operation, that is, from several GHz up to 6 GHz frequencies.

On the other hand, the folded configuration of the radiating elements having a surface parallel to the ground plane, achieve the complete frequency range in a reduced height of around $\lambda/33$.

Furthermore, the two feeding ports of radiating elements, are placed on an interior region of the ground plane, in order to achieve an omni-directional pattern of the antenna at whole band of operation.

Additionally, the antenna system comprises first, and second parasitic elements placed above the ground plane, and substantially coplanar or parallel to the horizontal surfaces of the radiating elements. Each parasitic element is connected with the ground plane and extends around one of the radiating elements. These parasitic elements fine tune the antenna system at the lower frequency band, around 700 MHz.

The ground plane has first and second opposing large edges and two opposing short edges, and preferably the ground plane has generally a rectangular shape. The vertical surfaces of the first and second radiating elements are transversally arranged with respect to the two opposing large edges. The two feeding points are closer to the first large edge of the ground plane.

Furthermore, the first and a second parasitic elements are generally L-shaped having a short segment and a large segment, and the horizontal surfaces of the radiating elements are placed between the large segment of one of the parasitic elements and one of the short edges of the ground plane.

The ground plane has first and second cut-outs at the short edges of the ground plane and placed below a part of the radiating element. The technical effect of these cut-outs is that an omni-directional radiation pattern of the antenna at the whole band of operation is achieved.

Additionally, the ground plane has a slot that extends from one of the large edges of the ground plane and transversally to the ground plane. Preferably the slot is straight and shorter than the short edges of the ground plane. The slot is placed between the two radiating elements, such as this arrangement of the slot at the ground plane, increases isolation between the two radiating elements of the antenna system.

Preferably, the first and second radiating elements and the first and second parasitic elements, are configured and arranged such as they are a mirror image of each other.

The ground plane might be implemented as a conductive layer on a surface of a (non-conductive) substrate, like a Printed Circuit Board (PCB). In that case, the antenna system may include a satellite navigation antenna (GNSS), attached to another non-conductive surface of the PCB, such as the substrate isolate the GNSS antenna from the radiating elements.

The antenna system of the of the present disclosure is preferably adapted to operate at least within one Long Term Evolution (LTE) frequency band, and to be used as remote antenna for a motor vehicle, and to provide 5G communication services.

Some of the advantages of the present antenna system are summarized below:

- LTE and 5G communication services are integrated in a reduced volume;
- No need for a ground connection to the vehicle, the antenna is itself grounded;
- Multiband behavior;
- High efficiency performance;
- Compatible to integrate a satellite navigation antenna (GNSS), including an amplifier splitter to be able to use the GNSS signal in several ECU's; and
- Compact geometry, maximum dimensions around $\lambda/5\times\lambda/8\lambda/33$ thus, it can be integrated within a confined space (wherein $\lambda$ is the lowest antenna wavelength).

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1A:
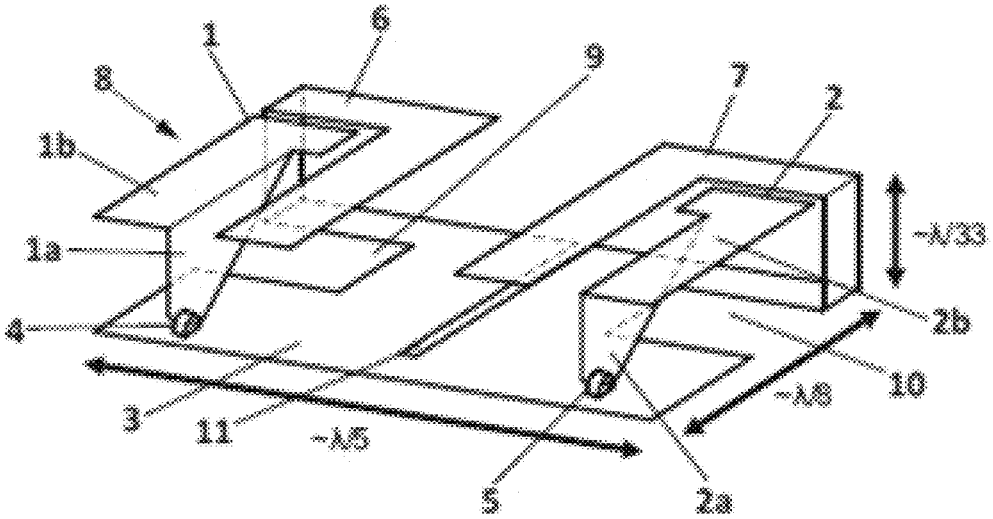
FIG. 1A is a perspective view of a preferred embodiment of an antenna system from above, and in accordance with the invention, and illustrating several measured lengths of several components of the antenna system.

The following description is merely exemplary in nature and is not intended to limit the present disclosure, its application or uses. It should be understood that throughout the drawings, corresponding reference numerals indicate like or corresponding parts and features.

FIGS. 1A, 1B, 1C, 2A, 2B, and 2C show one, non-limiting, embodiment of the antenna system 8 that comprises first and second radiating elements 1, 2 and a flat ground plane 3 in common for the two radiating elements 1, 2. The two radiating elements 1, 2 are placed above an upper face of the ground plane 3, and two feeding ports 4, 5 of the antenna system are respectively connected between the radiating elements 1, 2 and the ground plane 3, thus, the radiating elements are not directly connected with the ground plane 3.

Each radiating element 1, 2 is folded such as it has a vertical surface 1*a*, 2*a* and a horizontal surface 1*b*, 2*b*, and wherein the vertical surfaces 1*a*, 2*a* of the two radiating elements 1, 2 are orthogonal to the ground plane 3 and parallel to each other. Additionally, the horizontal surfaces 1*b*, 2*b* of the two radiating elements 1, 2 comprise a rectangular area, are coplanar between them, and parallel to the ground plane 3. Preferably, the length of the horizontal surfaces 1*b*, 2*b* is around $\lambda/10$ (see FIG. 1B).

The ground plane 3 is generally rectangular and as such, it has two opposing large edges 3*a*, 3*b* and two opposing short edges 3*c*, 3*d*, and the vertical surfaces 1*a*, 2*a* of the first and second radiating elements 1, 2 are transversally arranged with respect two opposing large edges 3*a*, 3*b*. Furthermore, each of the first and second radiating elements 1, 2 is closer to opposite short edges of the ground plane 3.

With the above-described arrangement of components, the antenna system 8 generally configures a rectangular prismatic volume which larger side is around $\lambda/5$, that is 77 mm at 700 MHz.

Taking in account that the lowest frequency of operation is at 700 MHz and the velocity of wave propagation over the air (v=3e8 m/s) the operative wavelength is ($\lambda$=v/f=3e8/700e6=428 mm). As described on FIG. 1A the antenna system can be enclosed in a housing (not shown), with maximum dimensions of 77×57×13 mm or around $\lambda/5\times\lambda/8\times\lambda/33$.

The antenna system 8 further comprises a first and a second parasitic elements 6, 7 connected with the ground plane 3 and substantially coplanar with the horizontal surfaces 1*b*, 2*b* of the radiating elements 1, 2, and therefore parallel to the ground plane, and extending around one of the radiating elements 1, 2.

Each parasitic element (6,7) is L-shaped having a short segment and a large segment, such as the horizontal surfaces 1*b*, 2*b* of the radiating elements 1, 2 are placed between the large segment of one of the parasitic elements 6, 7 and one of the short edges 3*c*, 3*d* of the ground plane 3. Preferably, the length of the large segment is around $\lambda/8$, and the length of the short segment is around $\lambda/16$, as shown in FIG. 1C.

Figure 2A:
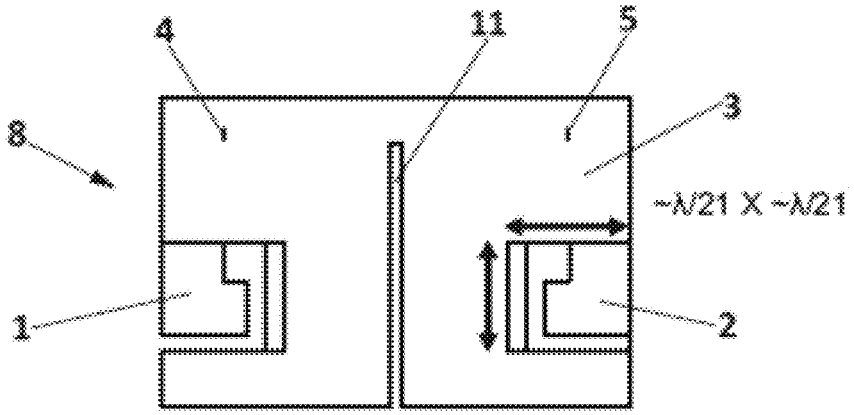
FIG. 2A is a bottom plan view of the antenna system.
Figure 2B:
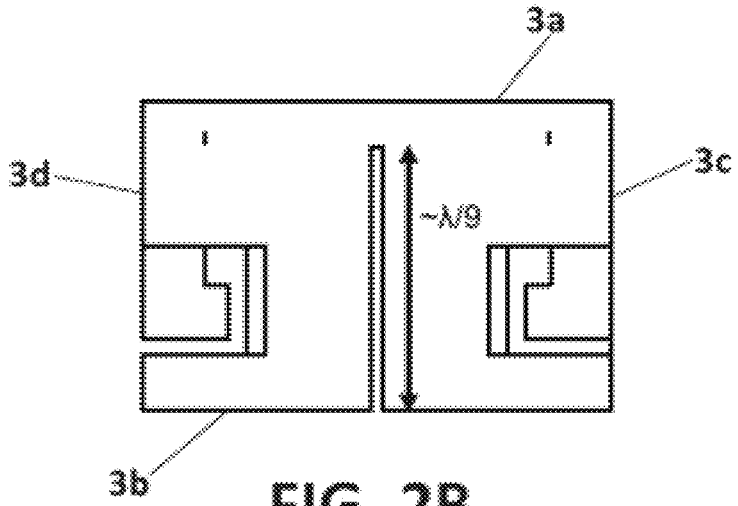
FIG. 2B is another bottom plan view of the antenna system.
Figure 2C:
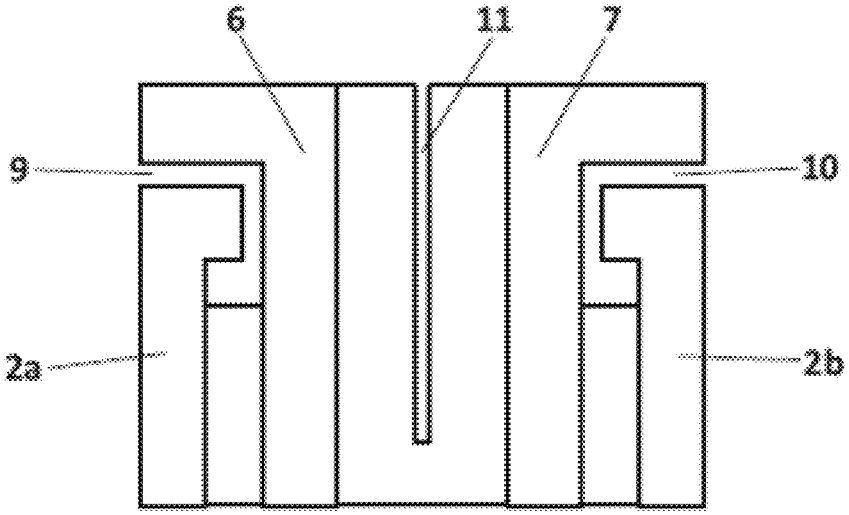
FIG. 2C is a top plan view of the antenna system.
Figure 3:
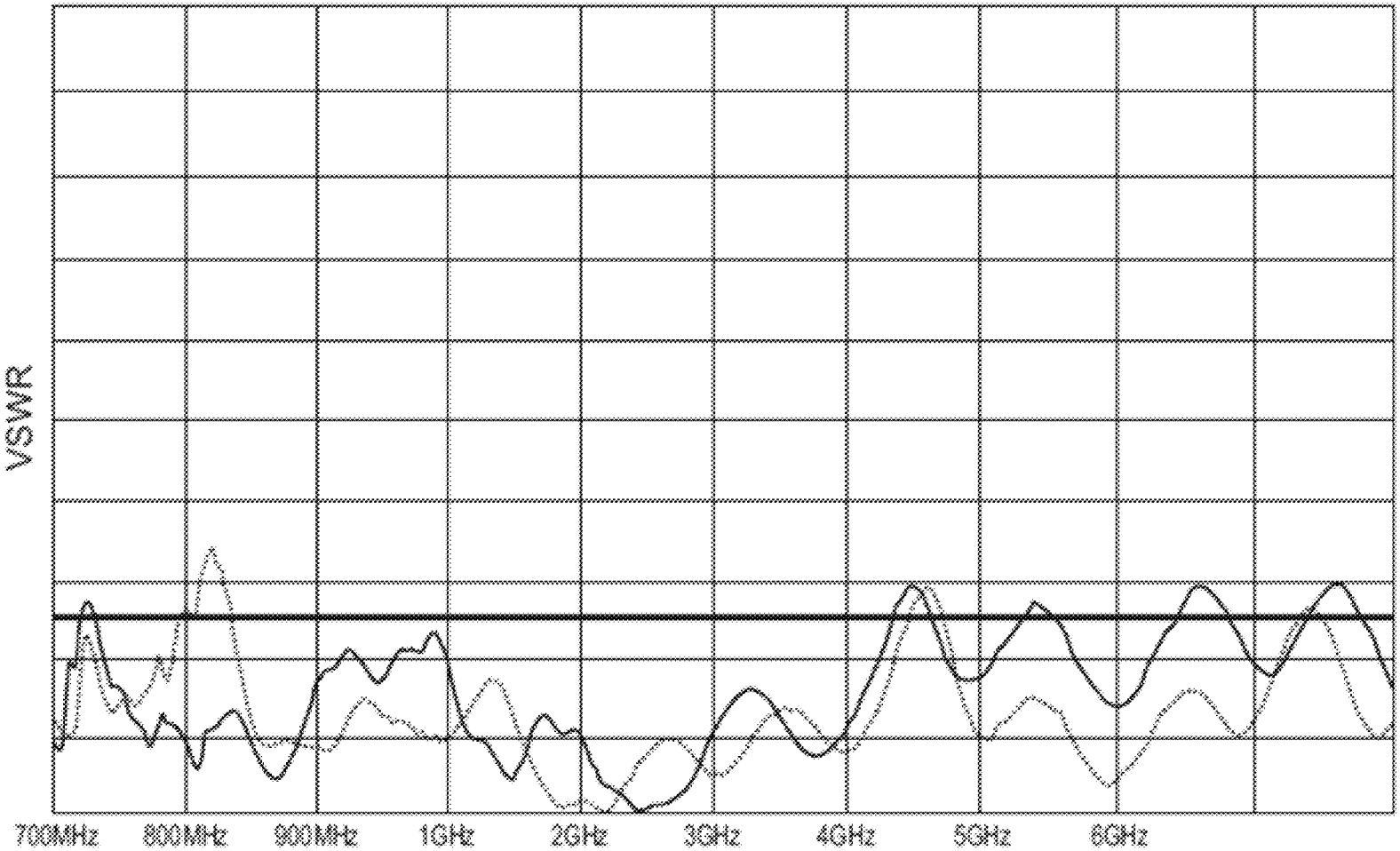
FIG. 3 is a graph corresponding to the matching of a first radiating element and a second radiating element of the antenna system.
Figure 4:
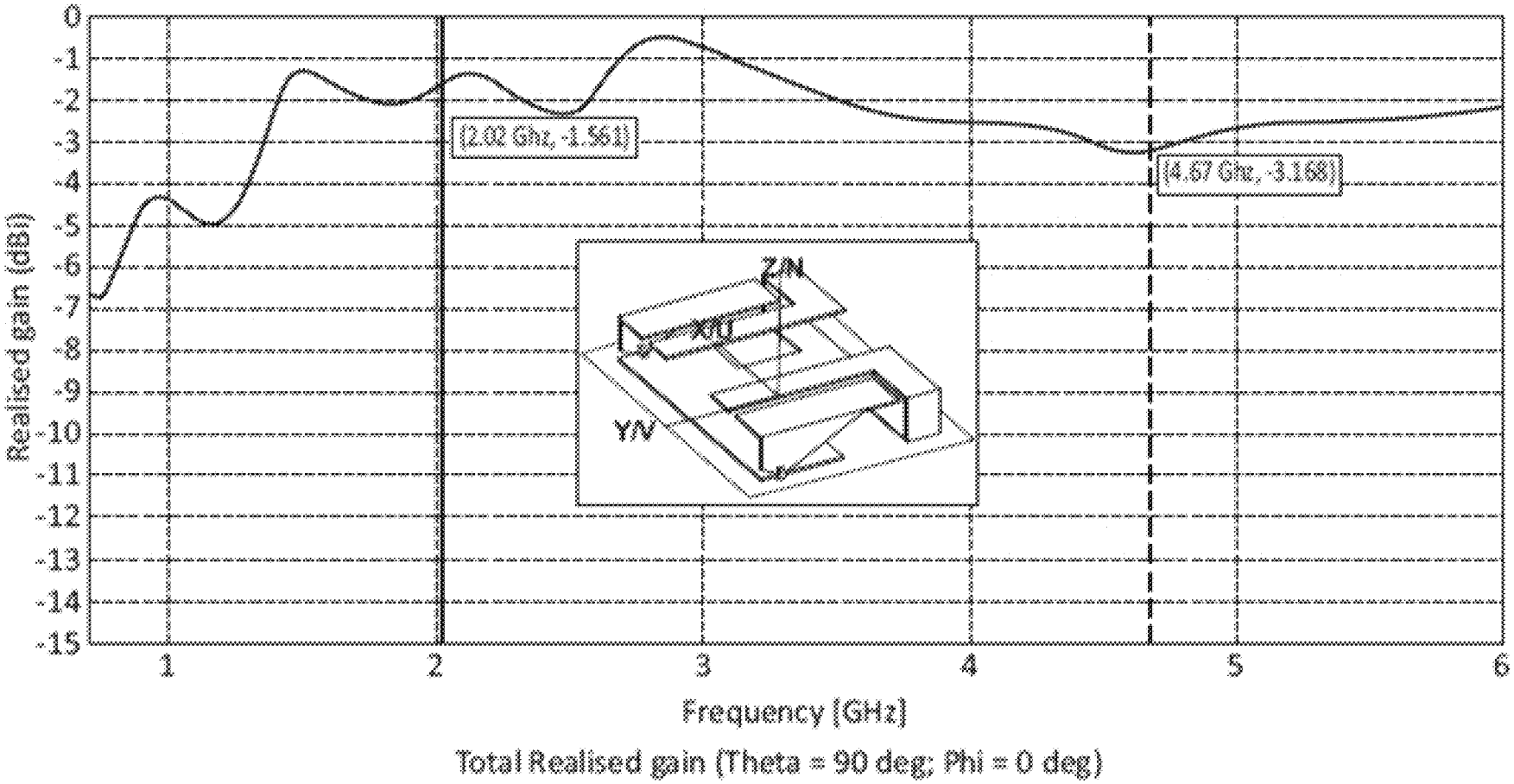
FIG. 4 is a graph corresponding to a Linear Average Gain (LAG)
Figure 5B:
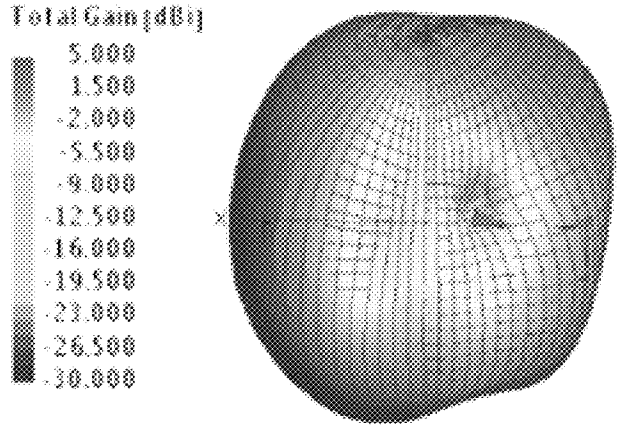
FIG. 5B is another representation of the LAG similar in perspective to FIG. 5A.
Figure 5C:
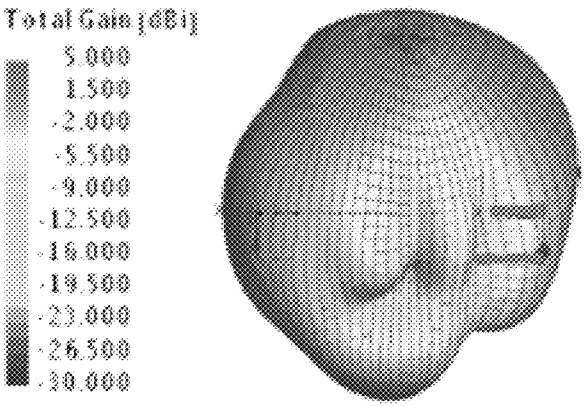
FIG. 5C is another representation of the LAG similar in perspective to FIG. 5A.
Figure 5A:
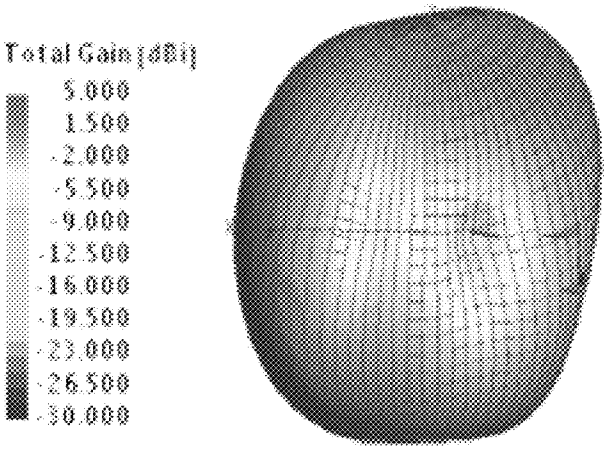
FIG. 5A is another representation of the LAG.

As shown in FIG. 2C, the large segment of the parasitic elements 6, 7 and the short edges 3*c*, 3*d* of the ground plane 3, have substantially the same length.

The vertical surfaces 1*a*, 2*a* are triangular and the feeding ports 4, 5 are connected with one of the vertex. The feeding ports 4, 5 are placed in an interior region of the ground plane 3, in particular as shown in FIG. 1B, the feeding ports 4, 5 are placed at a distance (d1) around λ/43 from one of the short edges 3*a*, 3*b* of the ground plane 3.

The ground plane 3 has first and second squared cut-outs 9, 10 at the short edges 3*c*, 3*d* of the ground plane 3, such as each cut-out has three edges with a length around λ/21. As shown in FIG. 2A the cut-outs 9, 10 are closer to the second large edge (3*b*) of the ground plane 3 than to the first large edge (3*a*).

Furthermore, the ground plane 3 has a slot 11 that extends from one the second large edge (3*b*) of the ground plane 3. The slot 11 is straight with a length of around λ/9, that is, shorter than the short edges 3*c*, 3*d*, and it is placed transversally and right at the center of the ground plane 3 as shown in FIG. 2C.

The antenna system 8 is a symmetric structure, such as the set formed by the first radiating and parasitic elements (1,6), and the set formed by the second radiating and parasitic elements (2,7), are a mirror image of each other. For that, the first and second radiating elements 1, 2 are configured and arranged such as they are a mirror image of each other, and similarly the first and second parasitic elements 6, 7 are configured and arranged such as they are a mirror image of each other.

Figure 1B:
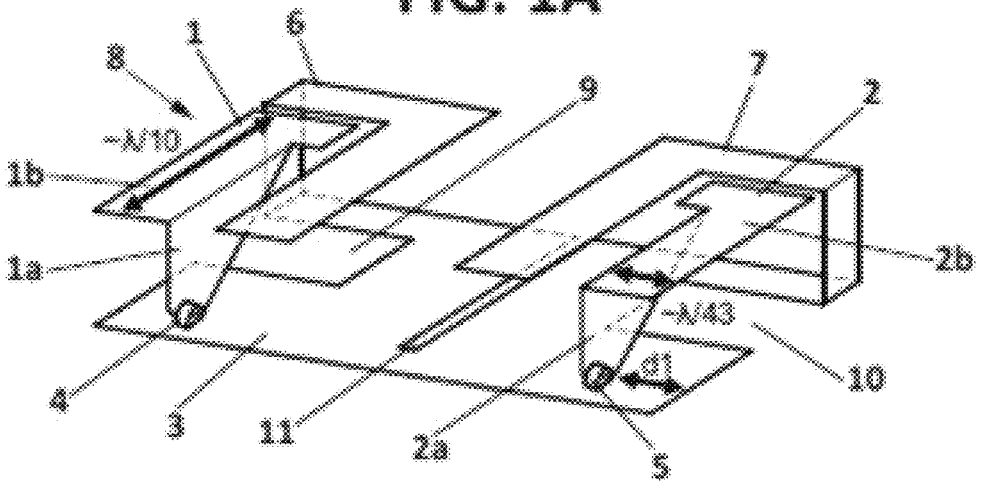
FIG. 1B is a perspective view of the antenna system from above, and illustrating several measured lengths of several components of the antenna system.
Figure 1C:
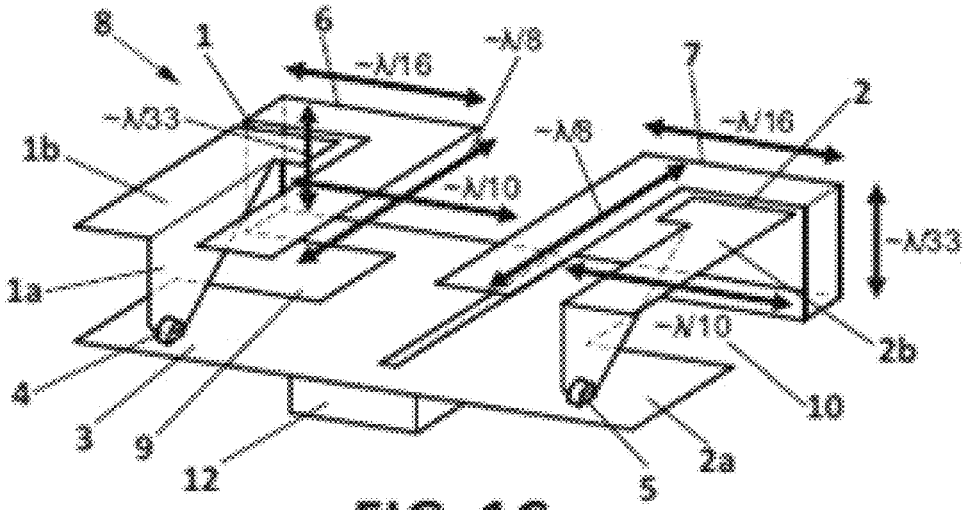
FIG. 1C is a perspective view of the antenna system from above, and illustrating several measured lengths of several components of the antenna system.

With this configuration, the antenna system 8 of the embodiment of FIG. 1A can be fitted inside a rectangular prismatic volume of dimensions around to λ/5×λ/8×λ/33.

The ground plane 3 is a conductive layer formed on one of the faces of a PCB (13). As shown in FIG. 1C, the antenna system 8 additionally comprises a satellite navigation patch antenna (GNSS) (12), attached to the other face (non-conductive) of the PCB (13), such as the PCB material serves to electrically isolate the GNSS antenna from the radiating elements.

Nevertheless, in other preferred embodiments and in order to provide a more compact solution, the GNSS antenna (12) might be placed on top of the ground plane 3 suitably isolated from the radiating elements.

The ground plane 3 can be implemented as a Printed Circuit Board (PCB), that includes GNSS circuitry like: an amplifier, filter, couplers, a GNSS splitter (to provides two outputs), etc., without affecting the antenna performance.

The effect of having the GNSS antenna (12) in the opposite face of the ground plane 3 to the location of the radiating elements 1, 2, is that the ground plane 3 isolates the GNSS antenna from the radiating elements 1, 2.

For applications in which the antenna housing can be made larger, a GNSS multiband or multi constellation stacked patch can be provided to cover several frequency bands.

The antenna system 8 is designed to operate at least within one Long Term Evolution (LTE) frequency band, wherein the lowest frequency of operation is 700 MHz. Additionally, the antenna system is further adapted to provide 5G communication services.

While the present disclosure is described with reference to the figures, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A dual broadband antenna system for vehicles, the antenna system comprising:

first and second radiating elements and a substantially flat ground plane in common for the two radiating elements, wherein the two radiating elements are placed above an upper surface of the ground plane, and wherein each radiating element is folded such as each radiating element has a vertical and a horizontal surface, wherein the vertical surfaces of the two radiating elements are substantially orthogonal to the ground plane and parallel to each other, wherein the horizontal surfaces of the two radiating elements are substantially coplanar between them and parallel to the ground plane, and the horizontal surfaces are L-shaped, wherein the antenna system further comprises two feeding ports respectively connected between the vertical surfaces of the radiating elements and the ground plane, wherein the antenna system further comprises a first and a second parasitic elements connected with the ground plane and substantially coplanar or parallel to the horizontal surfaces horizontal surfaces of the radiating elements, and wherein the first and a second parasitic elements are spaced directly above the ground plane and extend around respectively the first and second radiating elements.

2. The antenna system according to claim 1, wherein the area of the vertical surfaces widen progressively from the respective feeding ports towards the respective horizontal surfaces.

3. The antenna system according to claim 2, wherein the vertical surfaces have generally a triangular shape having one vertex connected respectively to the first and second feeding ports.

4. The antenna system according to claim 1, wherein the ground plane has first and second opposing large edges and two opposing short edges, and wherein the vertical surfaces of the first and second radiating elements are transversally arranged with respect to the two opposing large edges, and wherein the two feeding ports are closer to the first large edge of the ground plane than the second large edge.

5. A dual broadband antenna system for vehicles, the antenna system comprising:

first and second radiating elements and a substantially flat ground plane in common for the two radiating elements, wherein the two radiating elements are placed above an upper surface of the ground plane, and wherein each radiating element is folded such as each radiating element has a vertical and a horizontal surface, wherein the vertical surfaces of the two radiating elements are substantially orthogonal to the ground plane and parallel to each other, wherein the horizontal surfaces of the two radiating elements are substantially coplanar between them and parallel to the ground plane, wherein the antenna system further comprises two feeding ports respectively connected between the vertical surfaces of the radiating elements and the ground plane, wherein the antenna system further comprises a first and a second parasitic elements connected with the ground plane and substantially coplanar or parallel to the horizontal surfaces horizontal surfaces of the radiating elements, wherein the first and a second parasitic elements are placed above the ground plane and extend around respectively the first and second radiating elements, and wherein the first and a second parasitic elements are generally L-shaped having a short segment and a large segment, and wherein the horizontal surfaces of the radiating elements are placed between the large segment of one of the parasitic elements and one of the short edges of the ground plane.

6. The antenna system according to claim 5, wherein the large segment of the parasitic elements and the short edges of the ground plane, have substantially the same length.

7. The antenna system according to claim 1, wherein each of the horizontal surfaces comprises a rectangular area.

8. The antenna system according to claim 1, wherein the ground plane has first and second cut-outs at the short edges of the ground plane and placed under the radiating elements, and wherein these two cut-outs are closer to the second large edge of the ground plane than to the first large edge.

9. The antenna system according to claim 1, wherein the ground plane has a slot that extends from one of the large edges of the ground plane, and wherein the slot is shorter than the short edges of the ground plane, and wherein the slot is placed in between the first and second radiating elements.

10. The antenna system according to claim 1, wherein, the first and second radiating elements are configured and arranged such as they are a mirror image of each other, and wherein the first and second parasitic elements are configured and arranged such as they are a mirror image of each other.

11. The antenna system according to claim 1, further comprising a non-conductive substrate and a satellite navigation antenna (GNSS), wherein the ground plane is formed on one surface of the substrate and the satellite navigation antenna (GNSS) is attached to the other surface of the substrate.

12. The antenna system according to claim 1, wherein the antenna system fits inside a rectangular prismatic volume which larger side is around $\lambda/5$ long.

13. The antenna system according to claim 1, adapted to operate at least within one Long Term Evolution (LTE) frequency band.

14. The antenna system according to claim 10, wherein the lowest frequency of operation is 700 Mhz.

15. The antenna system according to claim 1, further adapted to provide 5G communication services.

16. The antenna system according to claim 3, wherein the ground plane has first and second opposing large edges and two opposing short edges, and wherein the vertical surfaces of the first and second radiating elements are transversally arranged with respect to the two opposing large edges, and wherein the two feeding ports are closer to the first large edge of the ground plane than the second large edge.

17. The antenna system according to claim 4, wherein the first and a second parasitic elements are generally L-shaped having a short segment and a large segment, and wherein the horizontal surfaces of the radiating elements are placed between the large segment of one of the parasitic elements and one of the short edges of the ground plane.

18. The antenna system according to claim 6, wherein each of the horizontal surfaces comprises a rectangular area.

19. The antenna system according to claim 7, wherein the ground plane has first and second cut-outs at the short edges of the ground plane and placed under the radiating elements, and wherein these two cut-outs are closer to the second large edge of the ground plane than to the first large edge.

20. The antenna system according to claim 8, wherein the ground plane has a slot that extends from one of the large edges of the ground plane, and wherein the slot is shorter than the short edges of the ground plane, and wherein the slot is placed in between the first and second radiating elements.

* * * * *